US005738755A

United States Patent [19]

Hartman

[11] Patent Number: 5,738,755

[45] Date of Patent: Apr. 14, 1998

[54] AUTOMATIC PRODUCT LABELLING SYSTEM

[75] Inventor: Michel Hartman, Cavaillon, France

[73] Assignee: Euro Label 06, Cavaillon, France

[21] Appl. No.: 605,375

[22] Filed: Feb. 22, 1996

[30] Foreign Application Priority Data

Feb. 22, 1909 [FR] France ..... 95 02055

[51] Int. Cl.[6] ..... B65C 3/00

[52] U.S. Cl. ..... 156/566; 156/363; 156/542; 156/DIG. 5; 156/DIG. 46

[58] Field of Search ..... 156/566, 362, 156/363, 364, 360, DIG. 5, DIG. 33, 574, 577, 542, 355, DIG. 46, 361

[56] References Cited

U.S. PATENT DOCUMENTS 3,944,455 3/1976 French ..... 156/DIG. 33 X
4,123,310 10/1978 Varon et al. ..... 156/568 X
5,387,302 2/1995 Bernard et al. ..... 156/577 X

FOREIGN PATENT DOCUMENTS 0 113 256 7/1984 European Pat. Off. .
0 593 382 4/1994 European Pat. Off. .
2 619 079 2/1989 France .
2 033 324 7/1972 Germany .
2 147 939 4/1973 Germany .

*Primary Examiner*—James Engel
*Attorney, Agent, or Firm*—Wenderoth, Lind & Ponack

[57] ABSTRACT

An automatic labelling system for products, such as fruits and vegetables, of the type including a conveyor (4) for feeding a product-receiving structure (2) to a labelling station (5) provided with a device for labelling the products. The product-receiving structure (2) includes a mechanism (3) for identifying the position of the products in the structure. The system also includes a sensor detector (6) for detecting the identifying means for causing the actuation of the labelling device of the labelling station.

6 Claims, 1 Drawing Sheet

AUTOMATIC PRODUCT LABELLING SYSTEM

BACKGROUND OF THE INVENTION

The present invention relates to a system for automatically labelling products such as fruits and vegetables.

There is already known in the art, for example, from document FR-A-2 619 079, an automatic portable labelling machine for placing labels on articles, which are evenly spaced apart on a reeled tape.

These manual machines however have a number of drawbacks, in particular as concerns the labelling rate.

In order to improve this labelling rate, there has been proposed in French patent application N° 94 12 752 filed on 25 Oct., 1994 in the name of the Applicant, an automatic system for labelling products, such as fruits and vegetables, placed in containers open in their upper part. The system comprises a conveyor for feeding the containers and bringing the latter to a product labelling station, which includes at least one overhead cross-beam extending over the conveyor and provided with a carriage carrying means for automatically labelling the products, and movable transversly over the conveyor for labelling the products.

There has also been disclosed in the French patent application N° 95 00 731, filed on 23 Jan., 1955 in the name of XEDA INTERNATIONAL, an automatic system for labelling products such as fruits and vegetables placed in containers open in their upper part. The system comprises a conveyor for feeding the containers and bringing them to a labelling station, which includes at least one overhead crossbeam extending over the conveyor and provided with a carriage carrying means for automatically labelling the products, transversly and longitudinally movable over the conveyor and in synchronism with the latter, for labelling the products contained in the containers as they move in the labelling station.

In these systems, the operation of the various labelling means of the labelling station is brought about by means for detecting the arrival of a container in the labelling station.

As soon as the arrival of a container is detected, the labelling of the products occurs automatically by contact between a part of the labelling means and the products.

However, it has been found that the position of the products in the containers may vary slightly in accordance for example with their shape and the disposition of the products in the sockets of the containers receiving these products, so that the labelling of certain products may be imperfectly effected.

SUMMARY OF THE INVENTION

An object of the present invention is therefore to overcome these problems.

The invention therefore provides a system for automatically labelling products, such as fruits and vegetables, of the type comprising a conveyor for feeding a product-receiving structure to a labelling station provided with product labelling means. The system is characterized in that the product-receiving structure comprises means for identifying the position of the products in the structure. The system further comprises means for detecting the identifying means for causing the actuation of the labelling means of the labelling station.

BRIEF DESCRIPTION OF THE DRAWINGS

A better understanding of the present invention will be had from the following description which is provided solely by way of example with reference to the accompanying drawings in which.

DETAILED DESCRIPTION OF THE INVENTION

Figure 2:
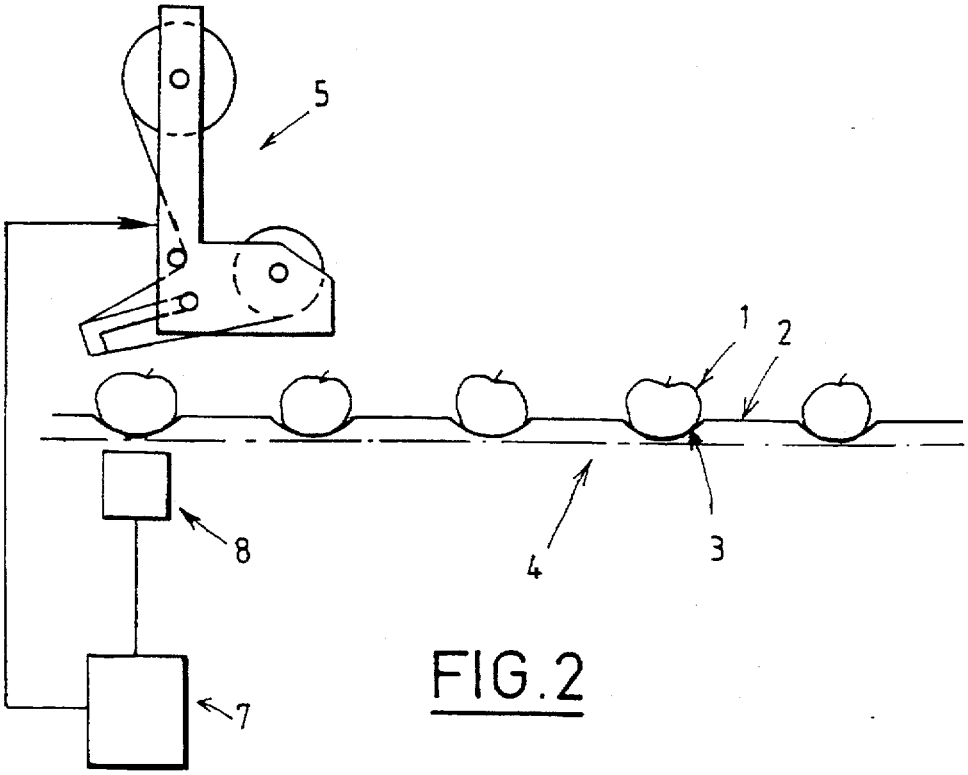
FIG. 2 illustrates a second embodiment of a labelling system according to the present invention.

Shown in FIG. 2 is a system for automatically labelling products, designated by the general reference numeral 1, constituted for example by fruits and vegetables and placed in product-receiving means designated by the general reference numeral 2.

In the embodiments shown in the Figures, these receiving means comprise a socketed structure for receiving the products. The structure of the receiving means comprises different aligned rows of sockets or cavities for receiving the products, one of which is designated by the general reference numeral 3 in the Figures.

The product-receiving structure is disposed on a conveyor 4 shown in dot-dash lines in the Figures. The conveyor is adapted to feed the product-receiving structure to a product labelling station designated by the general reference numeral 5 in the Figures.

The labelling station may comprise for example any suitable structure including product labelling means such as those disclosed in the aforementioned documents, with each labelling means being disposed in facing relation to a respective line of products of the receiving structure.

According to the present invention, the product-receiving structure designated by the general reference numeral 2 comprises means for identifying the position and more particularly for example the rows of products in the structure, and the labelling system comprises means for detecting the identifying means for causing the actuation of the labelling means.

In a first embodiment, the means for identifying the position of the products comprise visible marks provided on the receiving structure, for example in the region of the rows of products, and the detecting means may comprise optical means for detecting these rows, for causing the actuation of the labelling means upon the passage of the product receiving structure through the station.

In a second embodiment the identifying means comprise deformations of the structure, for example in the region of the rows of products and the means for detecting the identifying means comprise sensors for detecting the deformations.

Figure 1:
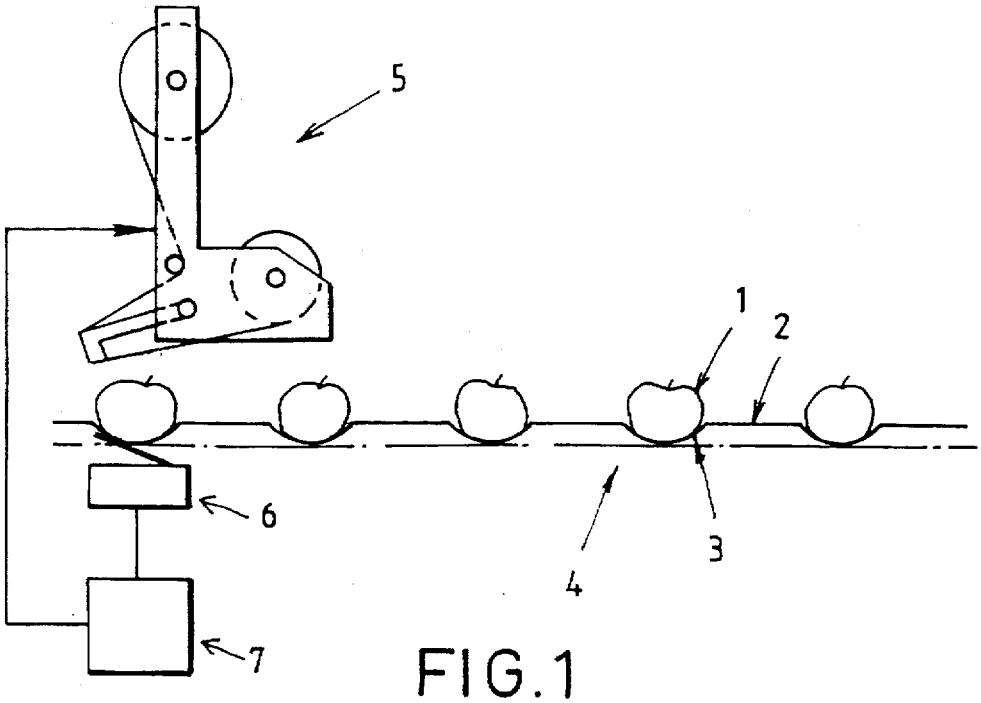
FIG. 1 illustrates a first embodiment of a labelling system according to the present invention.

It will be understood that the identifying means may be provided on a side of the structure opposite the side thereof placed on the conveyor, on a side of the structure placed on the conveyor as illustrated in FIGS. 1 and 2, or on the lateral sides of the structure.

Indeed, there is shown in FIG. 1 an embodiment of a labelling system according to the present invention in which the means for detecting the identifying means comprises for example a sensor of the end-of-travel type designated by the general reference numeral 6 adapted to detect the passage of the bottom of the sockets of the structure 2 carrying the products so as to cause the actuation of the labelling means by means of a central control unit, for example based on a microprocessor designated by the general reference numeral 7.

It will therefore be understood that, in this embodiment, the conveyor comprises for example rollers or belts permitting the positioning of this type of sensor 6 so that the latter can detect the bottom of each socket of the product-receiving structure 2 and cause the actuation of the labelling means.

The labelling of the products is therefore brought about upon the detection of the passage of the sockets and not of the products contained in the latter, which overcomes the previously-mentioned problems concerning an imperfect disposition of the products in the sockets.

Such socketed product-receiving structures are well known in the art and once the labelling of the products contained in the sockets of the structures has terminated, these structures are placed for example in a case or the like.

Various means for identifying the position of the products and various means for detecting the identifying means may be envisaged, such as for example the optical detecting means 8 shown in FIG. 2 which detects the passage of the sockets.

It will of course be understood that optical detecting means may also be used for example for detecting the passage of visible marks provided on, for example, a flat bottom of any product-receiving structure for causing the actuation of the labelling means of the labelling station 5.

Also, the detecting means may be provided on the other side of the conveyor i.e. on the side of the latter on which the labelling means are disposed, to control the latter upon the detection of the identifying means carried by the side of the product-receiving structure 2 opposite that placed on the conveyor, or, at least one of the lateral sides of the structure.

The identifying means are then, for example, formed by visible marks or corresponding deformations provided for example on the lateral sides of the product-receiving structure which is then in the form for example of a case or the like.

Depending on the disposition of the identifying means, the corresponding detecting means are disposed above and in facing relation or on the side of the conveyor for detecting the identifying means.

In the embodiments described with reference to FIGS. 1 and 2, the means for detecting the identifying means are placed just below the labelling means, but it will be understood that these detecting means may also be placed in a position which is reached before the labelling station in the direction of feed of the conveyor and actuates the labelling means with a given delay determined by the rate of feed of the conveyor.

What is claimed is:

1. A system for automatically labelling products, said system comprising:

a product receiving structure including a product position identifying means for identifying the position of products in said product receiving structure, wherein said product position identifying means is provided on a lower surface of said product receiving structure,;

a product labelling station including labelling means for labelling said products;

a conveyor for feeding said product receiving structure to said labelling station, wherein said lower surface of said product receiving structure is in contact with said conveyor; and a detecting means, positioned under said conveyor and operatively associated with said labelling means, for detecting said product position identifying means on said product receiving structure and actuating said labelling means upon detecting said product position identifying means, wherein said detecting means can detect said product position identifying means through said conveyor.

2. The system as claimed in claim 1, wherein said products comprise fruits and vegetables.

3. The system as claimed in claim 1, wherein said product position identifying means comprises visible marks provided on said product receiving structure, and said detecting means comprises means for optically detecting said visible marks.

4. The system as claimed in claim 1, wherein said product receiving structure is provided with sockets for receiving products therein, and said sockets form said product position identifying means, and said detecting means comprises sensors for detecting said sockets.

5. An apparatus for automatically labelling products, said apparatus comprising:

a conveyor having an upper support surface;

a product receiving structure supported on said conveyor, said product receiving structure having a surface configuration which is indicative of product positions in said product receiving structure;

a product labelling mechanism disposed adjacent said conveyor;

a detector disposed below said support surface of said conveyor and connected to said labelling mechanism, wherein said detector is operable to detect said a product position by engaging said product receiving structure through said conveyor and to actuate said product labelling mechanism upon detection of a product position in said product receiving structure.

6. An apparatus for automatically labelling product, said apparatus comprising:

a conveyor having an upper support surface;

a product receiving structure having a lower surface supported on said upper support surface of said conveyor, said product receiving structure being provided with a product position identifier on said lower surface;

a product labelling mechanism disposed adjacent said conveyor;

an optical detector located below said upper support surface of said conveyor and operatively connected to said labelling mechanism such that, upon feeding of a product receiving structure, said optical detector can detect said product position identifier and actuate said product labelling mechanism in response thereto.

* * * * *

UNITED STATES PATENT AND TRADEMARK OFFICE

CERTIFICATE OF CORRECTION

PATENT NO. : 5,738,755

DATED : April 14, 1998

INVENTOR(S) : Michel HARTMAN

It is certified that error appears in the above-indentified patent and that said Letters Patent is hereby corrected as shown below:

On the cover page, under [30] Foreign Application Priority Data, the foreign application data should read as follows:

--Feb. 22, 1995 [FR] France ..... 95 02055--.

Signed and Sealed this

Eighth Day of September, 1998

*Attest:*

*Attesting Officer*

BRUCE LEHMAN

*Commissioner of Patents and Trademarks*